United States Patent [19]

Post

[11] 4,006,543

[45] Feb. 8, 1977

[54] SKI BOOTS PROVIDING AMPLIFICATION OF EDGING ACTION

[76] Inventor: Daniel Post, P.O. Box 408, Averill Park, N.Y. 12018

[22] Filed: Oct. 7, 1975

[21] Appl. No.: 620,412

[52] U.S. Cl. ..... 36/121

[51] Int. Cl.[2] ..... A43B 5/04

[58] Field of Search ..... 36/1.5, 118, 121, 120

[56] References Cited

UNITED STATES PATENTS

| | | | |
|---|---|---|---|
| 3,475,835 | 11/1969 | Kovar | 36/1.5 |
| 3,747,235 | 7/1973 | Post | 36/118 |

FOREIGN PATENTS OR APPLICATIONS

| | | | |
|---|---|---|---|
| 2,049,957 | 4/1972 | Germany | 36/118 |

*Primary Examiner*—Patrick D. Lawson
*Attorney, Agent, or Firm*—Karl W. Flocks

[57] ABSTRACT

A ski boot for association with a ski providing lateral inclination of the ski exceeding lateral inclination of the central axis of the skier's lower leg by utilizing the extra lateral displacement of the front of the leg associated with rotation of the leg and comprising a foot-holding member, a lever, a front yoke, a strap and ski engagement means, so proportioned disposed and connected as to transfer this amplified inclination to the ski.

27 Claims, 14 Drawing Figures

Fig. 10a
Fig. 10c
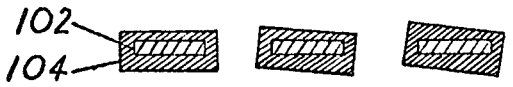
Fig. 10b
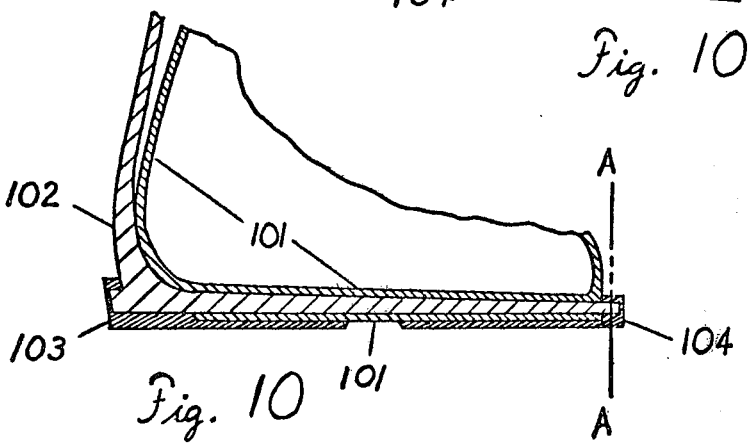
Fig. 10
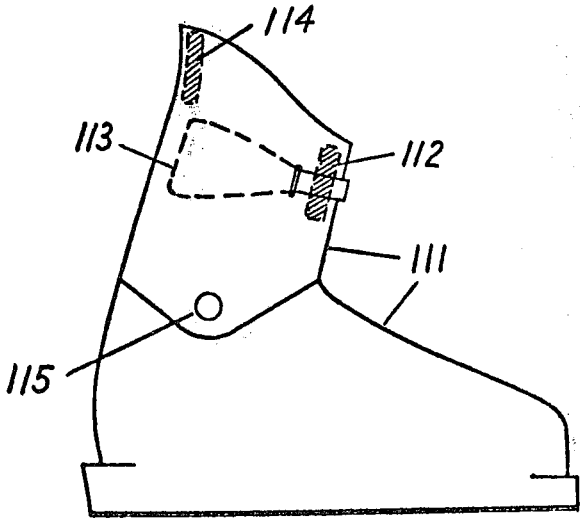
Fig. 11

SKI BOOTS PROVIDING AMPLIFICATION OF EDGING ACTION

BACKGROUND OF THE INVENTION

This invention teaches concepts for the design of ski boots that amplify the edging action of the ski. In modern skiing techniques, a dominant aspect of ski control is "edging," which is the ability to control the lateral angle of the ski with respect to the snow surface. Precise edging control is especially valuable in a forward lean position, when the skier is pressing forward against the upper portion of his boots.

Ski boots of early design were relatively flexible and the skier had to exert strong muscular restraints on lateral flexibility of the ankle to control edging action. Most of the ski boots currently available are made of stiff materials and have relatively little lateral flexibility; with these, edging ability of the skier is greatly facilitated.

Ski boot designers strive to transfer lateral angulation of the lower leg to the ski. Under ideal conditions where there is no lost motion between leg and boot, the edging angle of the ski equals the lateral inclination of the vertical axis of the skier's lower leg. However, lost motion is always encountered, caused for example by compression of boot padding and clothing and by compression of flesh and muscle under boot forces.

The lever-type ski boot of U.S. Pat. No. 3,747,235 exhibited numerous assets not related to edging, but in addition, contributed to further reduction of lost lateral motion through increased height of the leg-boot connection. The contact forces between leg and boot-top were thereby reduced, thus reducing compression of contact materials; and the angular displacement of the ski corresponding to any relative motion between leg and boot-top was also attenuated by virtue of the high position of the leg-boot connection.

In large measure, these improvements brought about the simplifications in skiing techniques employed today. Whereas prior techniques used greatly exaggerated angulation of the lower body to edge the skis, a more modest angulation is now used. The center of gravity of body weight is kept directly above the skis without severe body contortions and the more natural stance leads to easier, quicker body reactions.

The present invention teaches means for further enhancement of edging action. Even less angulation of the lower body is required for a given ski angulation, the body assumes an even more natural stance and body motions become still easier and quicker.

SUMMARY OF THE INVENTION

The present invention provides a ski boot with which the lateral inclination of the ski exceeds the lateral inclination of the skier's leg. This amplification of ski angulation with respect to leg angulation enables the skier to control his skis with smaller body movements; as a result, ease and quickness of performing skiing maneuvers is greatly enhanced. These unique and desirable performance characterists are achieved through use of a ski boot that transmits the lateral motions of the front of the lower leg of the skier, while exerting practically no restraint upon twisting motion of the leg.

Other objects and a fuller understanding of the present invention may be had by referring to the following description and claims, taken in conjunction with the accompanying drawings, in which:

FIG. 10 illustrates attachments to effect lateral canting of the boot;

FIG. 10*a* is a section taken along line A—A in FIG. 10 showing the relationship between a toe attachment over an extension of a lever for effecting lateral cant;

FIGS. 10*b* and 10*c* show arrangements similar to that in FIG. 10*a* but which effect different degrees of lateral cant to compensate for bowleggedness or other deviations; and FIG. 11 illustrates a ski boot configuration of this invention in which the yoke pad engages the lower portion of the lower leg.

PRINCIPLE OF THE INVENTION

Figure 1:
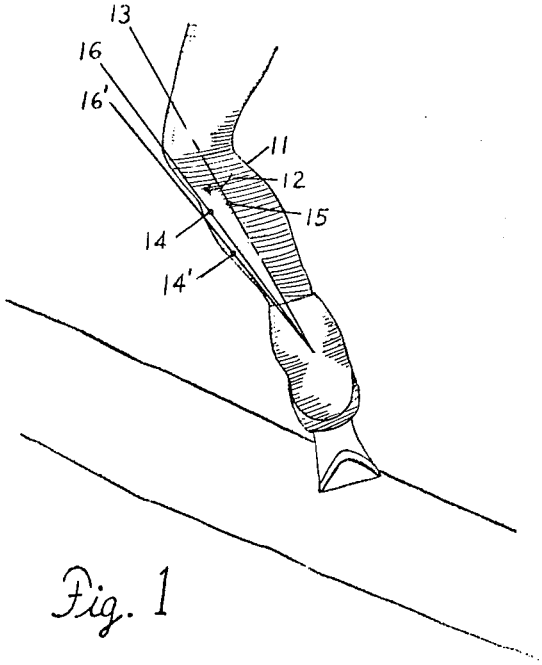
FIG. 1 depicts the kinematics of leg motion accompanying edging of the ski.

When edging his skis, a skier angulates his lower legs by moving his knees sideways (i.e. laterally), as indicated in FIG. 1. A subsidiary motion of the lower leg 11 always accompanies the primary movement, namely a rotation 12 of the lower leg about its central or rotational axis 13. As a consequence of this rotation, a point 14 on the front of the leg, i.e., a point that faced forward prior to lateral angulation of the leg, is displaced further to the left than a corresponding point 15 on the axis of the leg. A line 16 drawn through point 14 and the centerline of the ski experiences substantially greater lateral angular movement than line 13, which represents the axis of the leg.

A primary object of this invention is to provide ski boots that transfer the lateral angular motion of line 16 to the ski. This contrasts to prior art designs, where transfer of lateral motion of line 13 is sought. Since the inclination of line 16 exceeds that of 13, the ski experiences an angulation exceeding that of the axis of the leg; the angle of the ski is amplified with respect to the angle of the leg, i.e., an amplification of edging action is achieved.

Figure 2:
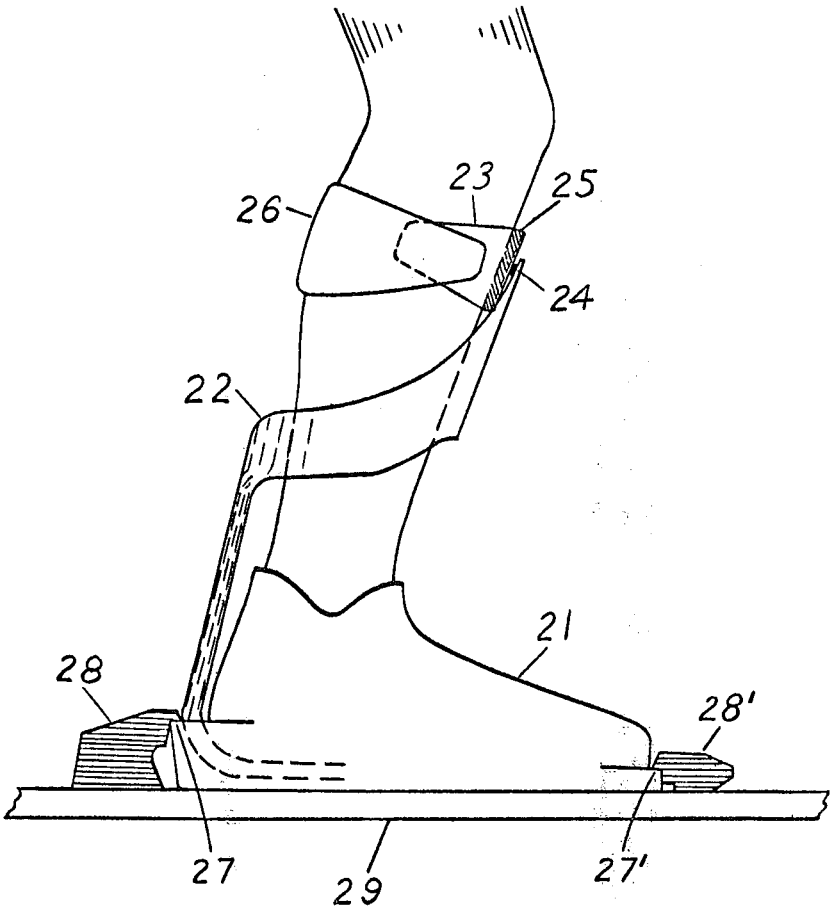
FIG. 2 illustrates a ski boot configuration incorporating shoe, lever, articulated front yoke and strap.

Transfer of lateral motion of line 16 is accomplished by the boot configuration of FIG. 2. It comprises a shoe 21, or other foot-holding means; a lever 22 firmly attached to the shoe and extending in front of point 14 on the leg; a yoke 23 pivotally or hingedly attached to lever 22 by means of connecting element 24 located in front of point 14; a yoke pad 25 that contacts the leg in the vicinity surrounding point 14; a strap 26 attached to the yoke and tying the leg thereto; and projections 27 and 27' or other means provided to engage safety release binding elements 28 and 28' which are firmly attached to ski 29, front and rear ends of which are broken away.

Figure 3:
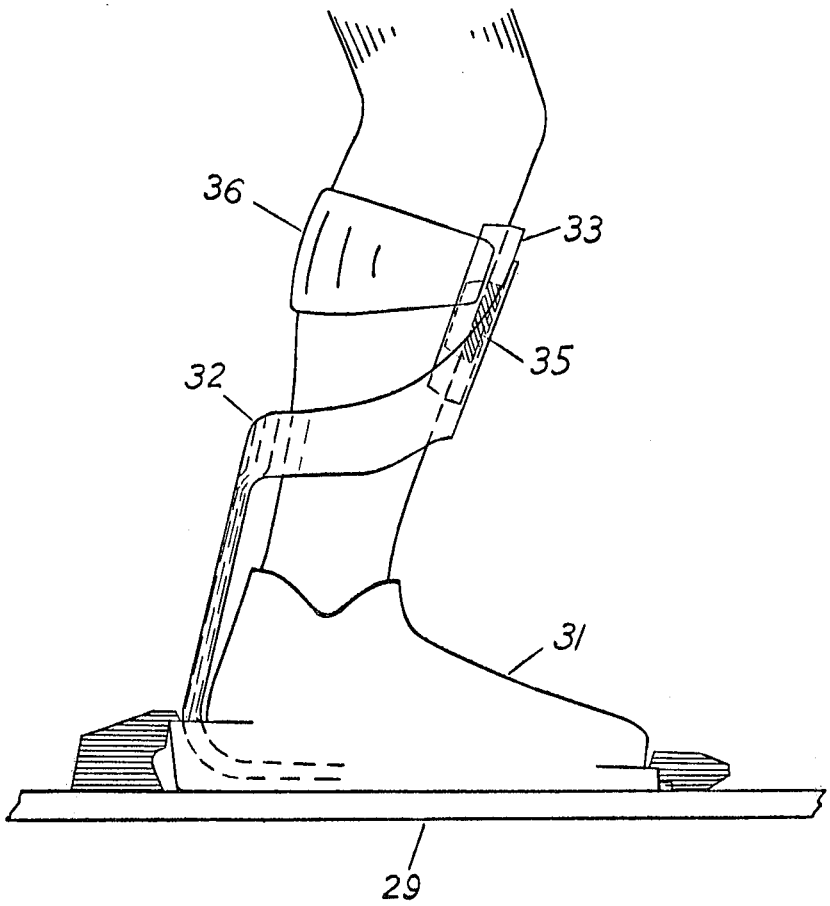
FIG. 3 illustrates a ski boot configuration incorporating shoe, lever, shallow front yoke and flexible strap.

Transfer of lateral motion of line 16 can also be accomplished by the ski boot configuration illustrated in FIG. 3. In this configuration lever 32 again extends in front of point 14; however, shallow yoke 33 is firmly fastened to lever 32 without means for articulation; shallow yoke pad 35 contacts the leg; and flexible strap 36 is attached to the yoke and ties the leg thereto.

In use, frictional forces between the leg and yoke pad 25 (or yoke pad 35) prevents relative motion between the contacting surfaces of the leg and yoke pad. Consequently, motion of point 14 on the front of the leg is transmitted to the yoke pad and thence to yoke 23 (or 33) and lever 22 (or 32). As a result the lateral angular motion of line 16 is transferred to the lever and to the ski and amplification of edging action is achieved.

In the configuration illustrated in FIG. 3, yoke 33 must be shallow, for otherwise it would restrict rotation of the leg about line 16. A shallow yoke is one in which the arch of the yoke is deep enough to engage a front portion of the leg, but not deep enough to substantially engage and react to movements of the sides of the leg.

The lever 22 (or 32) must be designed to transfer lateral angular motion of line 16 to the heel or sole of the boot and therefore must have very large lateral stiffness, while its longitudinal stiffness may be lower to allow forward motion of the leg. Transfer of lateral angular motion of line 16 also requires high torsional stiffness for levers of the form illustrated by 22 (or 32). Fiberglass would be one material suited to accommodate these requirements.

The yoke 23 (or 33) too, must be of stiff material to transfer forward and lateral motions of the front of the leg to the lever. The yoke pad 25 (or 35), shaped to the curve of the leg, is of soft material to cushion and spread the contact forces.

The strap 26 (or 36) must restrict rearward motion of the leg, but it must not substantially inhibit rotation of the leg around line 16. A construction of suitably high tensile strength and low flexural rigidity would be appropriate.

The shoe 21 (or 31) may be of the low quarter type or extend above the ankle. The sole and upper of the shoe may be either stiff or flexible, but the upper must be designed so that is does not substantially inhibit rotation of the leg at the ankle joint.

Referring again to FIG. 1, it can be seen that another point 14' on the front of the lower leg, but lower than point 14, experiences approximately the same lateral displacement from rotation 12. The angle of line 16', however, is greater than that of line 16, and the effect of lowering the contact point is an increase of the amplification of edging action. Therefore, the height of leg contact with the yoke pad determines the amount of amplification. A special feature derived from this understanding is achieved with a boot design in which the height of yoke pad 35 can be varied, thus varying the amplification of edging action.

Whereas a point 14 (FIG. 1) on the front of the leg experiences an increased lateral displacement as a result of rotation 12, a corresponding point on the back of the leg experiences a decreased lateral displacement. Consequently, a boot that transmits lateral motion of the front of the leg amplifies edging action, while a boot designed to transmit lateral motion of the back of the leg produces the opposite effect — it deamplifies or attenuates edging action. Thus, a boot with a rear yoke designed according to lever-type ski boot U.S. Pat. No. 3,747,235, except that the rear yoke is made shallow and the strap is flexible, would attenuate edging action. In the illustrated examples of that patent, the yokes are not shallow and they all transmit the lateral motion of the side of the leg, which is equal to the lateral motion of axis 13. These prior art boots neither amplify nor deamplify edging action of the ski.

Ski boots of conventional design, where a stiff cuff or collar contacts the front, rear and sides of the lower leg, also respond to the lateral motion of the sides of the leg and transmit the lateral angular motion of the central axis 13 of the leg.

IMPLEMENTATIONS

Figure 4:
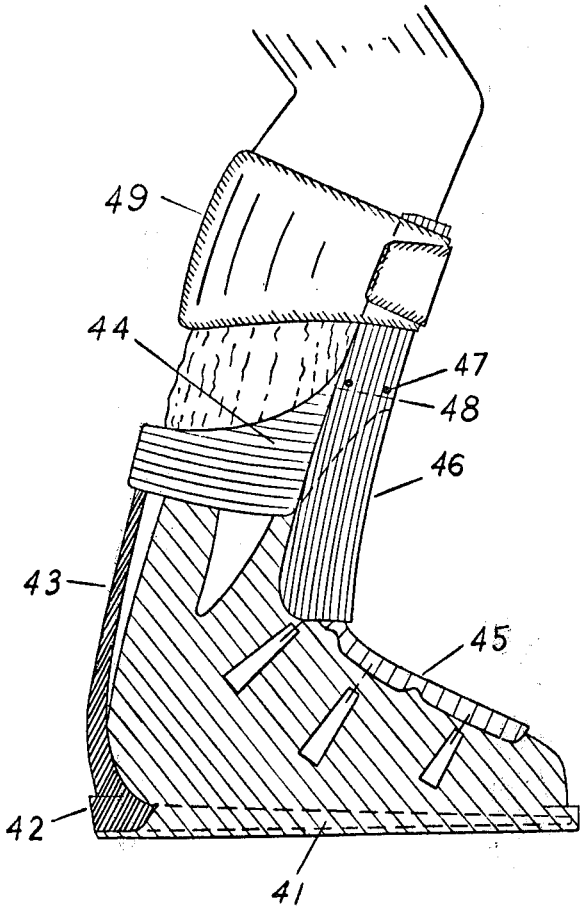
FIG. 4 illustrates a refined version of the ski boot of FIG. 3.

FIGS. 2 and 3 illustrate simplified structrual embodiments of this invention, but numerous variations and refinements are applicable. Certain refinements are illustrated in FIG. 4. In this implementation the lever is designed with an extension 41 on the bottom that is engaged firmly with the sole of the shoe. This extension may fit into a correspondingly shaped cavity or channel to facilitate its fixation and also to allow easy interchangeability of levers.

Heelpiece 42 is made as an integral part of the lever. Consequently there is no relative motion between heelpiece and lever, providing high fidelity of lateral motion transmission from lever to binding 28 to ski 29.

Section 43 of the lever is made relatively wide in the lateral direction to provide great resistance to lateral flexure and relatively thin in the orthogonal direction to provide less resistance to forward and rearward flexure. This longitudinal flexure can be varied by varying the materials, their disposition, and the dimensions of this section of the lever, so as to be suitable for different skiers and skiing styles.

Torsional stiffness of lever section 43 diminishes with its thickness. In implementations utilizing fiber reinforced composites, such as fiberglass, the ratio of torsional to longitudinal stiffness can be maximized with a bias construction, i.e., a construction in which the fibers are oriented symmetrically at plus and minus 45° to the long dimension of section 43. Since material near the outer surfaces of the lever is most effective in resisting both flexure and torsion, the design may utilize a hollow construction, a core of non-structural material such as a lightweight foam, or a core of structural material such as a non-oriented fiber reinforced composite. With any core, however, torsional stiffness is enhanced with bias orientation of fibers in the outer layers of the lever.

The upper portion 44 of the lever surrounds the leg, although clearance is provided so it does not contact the leg, and extends at the front to the upper part of the lower leg. Portion 44 may be constructed as an integral part of the lever or it may be fabricated as a separate part and firmly attached to portion 43.

In the design of FIG. 4 a shallow yoke exists as a consequence of the curvature of the front portion of 44 and no separate structural element is required; the yoke is a part of the lever in this case.

Figure 5:
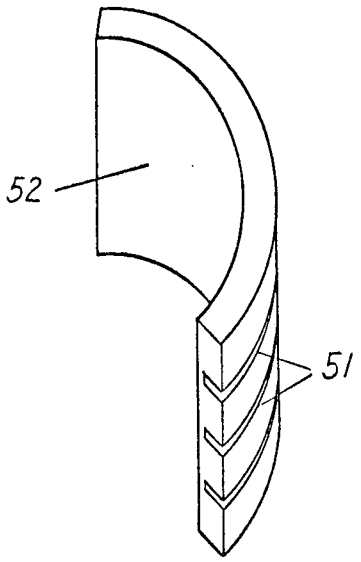
FIG. 5 illustrates one form of a yoke pad which may be used in the present invention.

Contact between the yoke and leg is made through a yoke pad 35 (shown in FIG. 3 but not shown in FIG. 4). This pad may be attached to the yoke with a non-permanent adhesive or other means so it can be removed and relocated at different heights along the yoke. One design of the yoke pad is illustrated in FIG. 5; serrations 51 reduce its resistance to vertical shear displacements and minimize possible scuffing between the pad and leg. The inner surface 52 is a high friction material which aids in the positive transmission of the lateral displacement of the front of the leg.

The embodiment of FIG. 4 utilizes a front entry shoe 45 with padding in the foot contact portion and buckles to close the shoe snuggly around the foot. This design effectively holds the heel of the foot in place and it effectively transmits foot swivel motions to the ski. The shoe is flexible above the foot contact portion and padded with soft, flexible material so as not to inhibit ankle movements consistent with rotation 12 of the leg.

To facilitate foot entry and exit, mechanical means can be provided to hold the overlapping flaps of the shoe temporarily in the open position. For example, the flap closure buckles can be designed to serve a double function, wherein they also bridge the gap between flaps in the open position and firmly hold them open. Numerous linkages can be designed for this function, either as a part of the shoe closure means or as independent means.

Snowshield 46 may be provided to inhibit entry of snow into the boot while skiing and it enhances the appearance of the boot. It is made of a tough flexible material such as urethane rubber. The snowshield is attached to the upper portion of the lever by adhesive bonding or by rivets 47 or other fasteners. The flexibility of the snowshield allows the lower portion to be folded up about a line 48 below the fasteners to allow for easy adjusting and buckling of the shoe 45. Folding or hinging along other lines are viable alternatives.

Strap 49 is made of a strong, flexible fabric; it is padded in the region of contact with the leg and it utilizes a convenient Velcro fastener in the front.

Innumerable cosmetic modifications can be applied for decorative or aesthetic enhancement of the boot. Various other structural arrangements and refinements can be utilized, too, to implement this invention. For example, the various front yoke implementations of the lever-type ski boot specified in U.S. Pat. No. 3,747,235, and their related refinements, when modified by substituting the articulated yoke of FIG. 2 or the shallow yoke and flexible upper strap of FIG. 3, become implementations of the present invention. The change of construction engendered by this improvement over the prior art may seem minor, but the resultant improvement in skiing performance is a previously unexpected, exciting advance. Teaching the mechanics and means of this amplification of edging action opens frontiers of great importance.

SPRING RATE, PRELOADING

Figure 6:
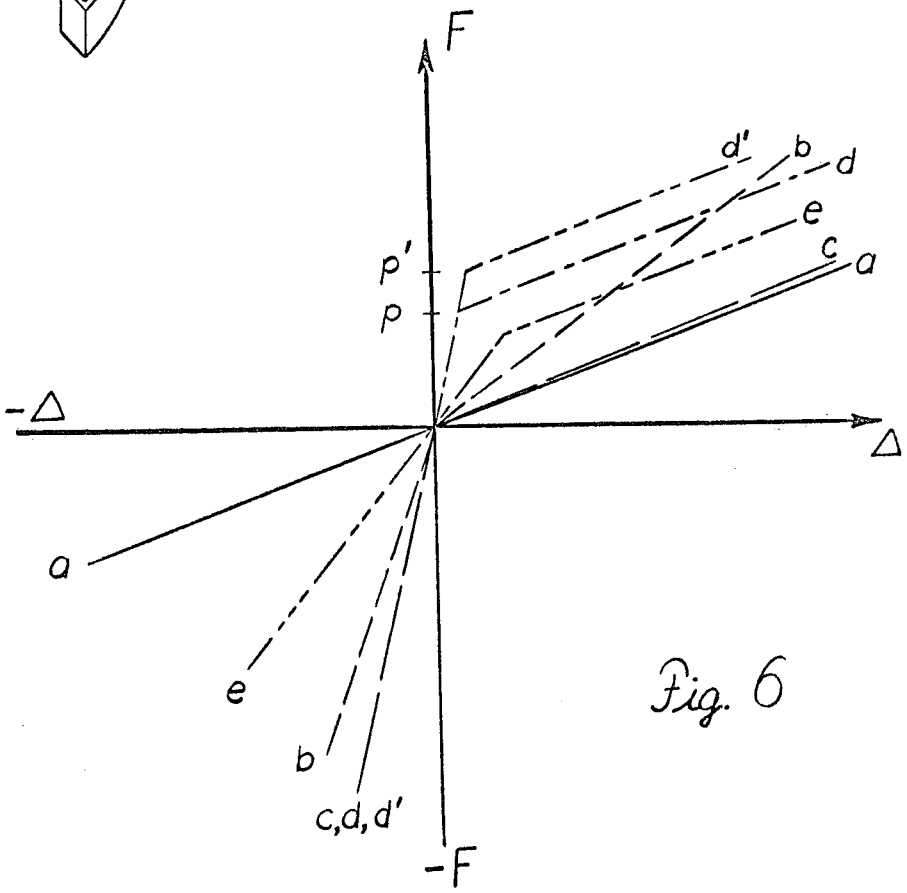
FIG. 6 shows graphs of relationships between force applied to the yoke and displacement of the yoke for various implementations of this invention.

The spring rate of lever 22 and lever 32 is shown graphically by line a in FIG. 6. Here F is forward force applied to the yoke and $\Delta$ is forward displacement of the yoke. Negative values in the graph represent rearward forces and rearward displacements with respect to the neutral position or zero-force position of the yoke. The slope of line a varies with stiffness of the lever; for example, the slope would increase if the leaf spring section of the lever were increased in thickness or made of material of higher modulus of elasticity.

Figure 7:
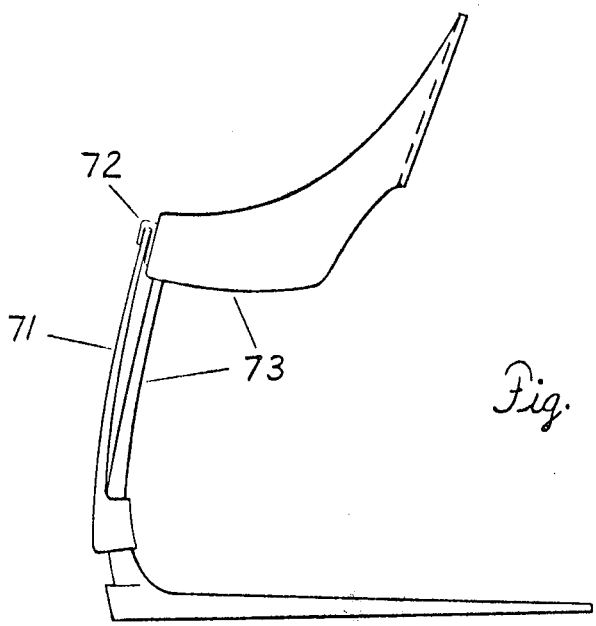
FIG. 7 illustrates an attachment to modify longitudinal flexibility of the lever.

Another means of varying the longitudinal flexibility of the lever is through the use of an attachment, one version of which is illustrated in FIG. 7. Here, a leaf spring 71 is fastened at the bottom to lever 73 and engaged by part 72 at the top to act in unison with the lever 73, thus increasing its longitudinal stiffness. With the illustrated design, rearward stiffening exceeds forward stiffening, since for rearward motion the spring is restrained vertically relative to the lever 73. The force-displacement graph for this case is given by *b* in FIG. 6, where the increase of forward resistance and the even greater increase of rearward resistance is illustrated.

Figure 8:
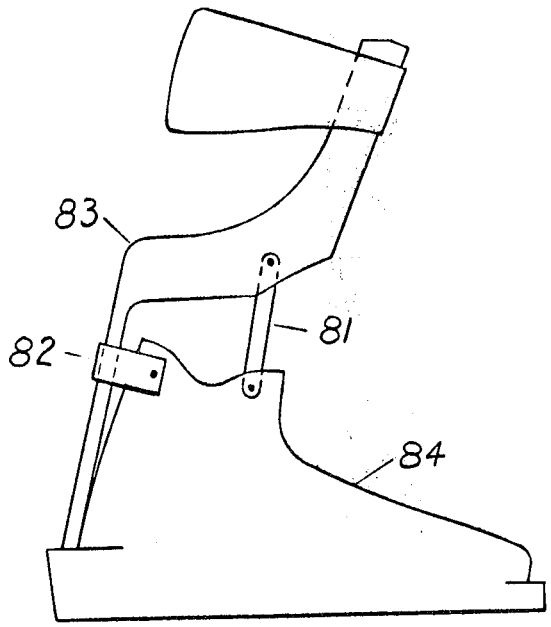
FIG. 8 shows schematic representations of other attachments that may be used to modify longitudinal flexibility of the lever.

Two other types of attachments for varying longitudinal flexibility of the lever are indicated in FIG. 8. Attachment 81 is connected between lever 83 and shoe 84 and two such units are disposed on either side of the leg, i.e., the left and right sides of each leg.

Attachment 81 may be a flexible steel cable. Then, it would have negligible effect on forward resistance, but would greatly increase rearward resistance, as shown by graph *c*.

Lever 83 can be preloaded by using shorter steel cables, such that the lever is flexed or loaded when the cables are attached. This preloaded configuration is represented by *d* in the graph. The boot offers great resistance to motion until preload force *p* is applied to the yoke; thereafter the cable is unloaded and the spring rate is that of lever 83 acting alone.

The cables of attachment 81 may be constructed with means for adjusting their length, for example with a turnbuckle or other screw arrangement. Preload force *p* is thereby adjustable, increasing as the cable is shortened and decreasing as the cable is lengthened. An increase of preload to $p'$ is indicated by graph $d'$.

Attachment 81 may be an elastic member, for example one of high durometer rubber. This would provide greater flexibility than the steel cable for forces below the preload force, as indicated by graph *e*. If rubber members are made with variously positioned holes in each end, changes of preload would be accomplished simply by engaging different pairs of holes in the lever and shoe connections.

Similar modifications of longitudinal flexibility can be accomplished by attachment 82 located behind the leg. Attachment 82 can be a metal clip or cable that restricts rearward motion of the lever 83 with respect to the shoe 84; in that case graph *c* would be applicable. Preload means whereby the lever is forced forward would yield graph *d*, and adjustable preload means would permit adjustment to $d'$. If attachment 82 acts as a tension spring, graph *e* would result. Other modifications of longitudinal flexibility result if attachment 82 includes a compression spring or a dashpot (shock absorber) or any combination of all of these.

Means for disengaging and interchanging various attachments can be provided readily by those skilled in the art. Numerous other attachments can be designed by those skilled in the art to modify the longitudinal flexibility characteristics of the lever, including devices to increase or decrease its flexibility for preloading and devices for equal or unequal effect upon forward and rearward stiffness.

Preloading offers very significant advantages to the skier. With preload the boot is relatively stiff near the neutral position and provides firm support to the lower leg, allowing the skier to control the position of his center of gravity with relative ease and precision. Thus, initiation of maneuvers is enhanced. In addition, the neutral position is well defined. The skier need not search for the neutral position and thus precision of movement for completion of maneuvers is enhanced.

While substantial forward motion of the leg is highly desirable, rearward movement from the neutral position is not. Optimal rearward motion is only that necessary to cushion rearward shocks. Preloaded systems with graphs similar to *d* and *e* appear to give best performance.

LATERAL CANTING

Figure 9:
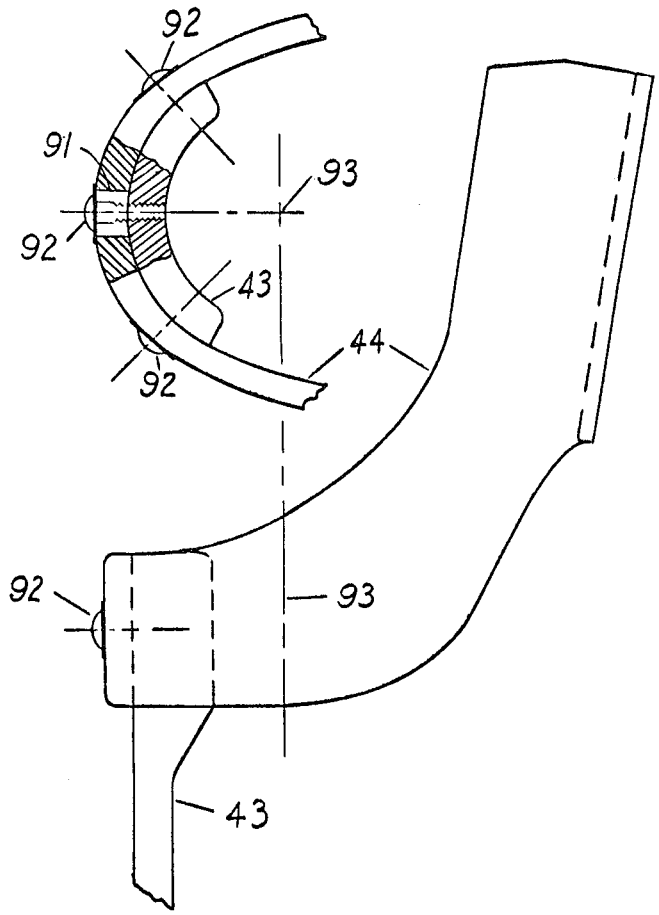
FIG. 9 illustrates a means of canting the boot top.

Implementations of this invention in which lever portions 43 and 44 are separate parts may incorporate an adjustable feature at the connection to effect lateral canting of the upper part of the boot with respect to the lower. Thus, adjustments can be made to accommodate for bowleggedness or other deviations from normal leg anatomy. One effective design is illustrated in the two orthogonal partial views of FIG. 9, where the mating surfaces of 43 and 44 are cylindrical in shape. A range of relative motion is provided by slots 91 prior to locking by screws 92. Rotation of 44 about axis 93 of the mating cylindrical surfaces causes a lateral displacement of the front of the lever, adjusting its position to match that of the front of the skier's leg.

Another means of lateral canting is through use of attachments at the heel and toe of the boot, such as those illustrated in FIGS. 10, 10*a*, 10*b* and 10*c*. FIG. 10 shows a cross-sectional view through the lower portion of a boot similar in construction to that in FIG. 4, wherein section 101 represents the shell of the shoe, 102 represents the lever and 103 and 104 represent attachments therefor. Attachment 103 has the external shape of the standardized heel shelf and the sole tread, while attachment 104 has the external shape of the standardized toe shelf and the sole tread. Canting is effected by varying the angular disposition between these interchangeable attachments 103, 104 and lever 102. This is illustrated for the toe shelf by the alternative views of Section A-A depicted in FIGS. 10*a*, 10*b* and 10*c* where FIG. 10*a* represents the disposition for normal cant and FIG. 10*b* and FIG. 10*c* represent dispositions for increasing lateral cant.

Cant attachments can be molded or otherwise produced with a series of different cant angles. Since heel and toe dimensions are the same for all boot sizes, one set can fit all boot sizes. A tough, wear-resistant material such as urethane rubber is suitable for these attachments.

A set of cant attachments 103 and 104 can be selected to fit the requirements of any individual skier and attached to the boot. Attachment would be accomplished by adhesive bonding, by mechanical interlocking or dovetailing of corresponding projections and grooves, by mechanical fasteners such as screws or by combinations of these.

AMPLIFICATION OF EDGING WITH LOWER BOOT

It is noteworthy that the amplification of edging taught here does not diminish or fade as height of the front yoke pad decreases, but rather the amplification acutally increases. In addition to being applicable to improved lever-type ski boots in which the lever extends to the upper portion of the lower leg as discussed above, the concept of amplification of edging also applies to boots extending only to the lower portion of the lower leg. Such an implementation is illustrated schematically in FIG. 11. Here the foot is held snuggly by the lower portion of stiff boot shell 111 by action of a padded shell lining and shell closing means. The front of the lower leg is held firmly against shallow yoke pad 112 by strap 113 which may buckle or fasten outside the shell. Clearance is provided between the strap 113 and walls of the shell 111 to allow substantially unrestrained rotation of the leg about a line 16′ through the front of the leg. A refinement of this approach may be used wherein the shell extends to a greater height at the rear and a rear pad 114 engages the leg at a higher location during sit-back maneuvers. Rear pad 114 must be located so as not to substantially inhibit rotation of the leg about 16′ while the leg is in forward or neutral lean positions, but to firmly contact the leg for rearward lean positions.

In the implementation of FIG. 11 the upper portion of shell 111 is actually a lever. The shallow yoke is the curved front portion of the lever that supports shallow yoke pad 112. Its external design is more similar to boots of the anklecuff type and features known for such boots can be utilized here too. For example, the upper structural element may be hinged to the lower through hinge 115 and known means of restraining and limiting the hinging action may be employed.

PREFERRED IMPLEMENTATION

Numerous implementations of ski boots that provide amplification of edging action have been described through illustration, description and modifications of the prior art. Of these, an implementation similar in design to that illustrated in FIG. 4 but with preload attachments 81 of the adjustable steel cable type, with mechanical means to temporarily hold open the flaps of the shoe, and with cant attachments of FIG. 10, is preferred. This boot allows a relatively natural body stance and very quick maneuvers in skiing by virtue of its amplification of edging; it allows variation of amplification through relocation of the yoke pad; it provides for effective heel hold-down and foot swivel action; contact pressures against the foot and leg are modest; its unvarying flex pattern allows sensitive control of force distribution on skis; its preload gives quick ski reaction and precise leg orientation near the neutral lean position; its leverage allows powerful loading of skis and excellent sit-back support; lateral cant is adjustable; foot entry and exit is easy and comfortable; with the upper strap unfastened, walking is relatively natural and easy.

It is to be understood that while the above has been indicated as the preferred implementation, numerous variations or modifications therein may occur to those having skill in this art and what is intended to be covered herein is not only the illustrated forms of the invention, but also any and all modified forms thereof as may come within the spirit of said invention.

What is claimed is:

1. A ski boot for association with a ski, providing amplification of edging action, comprising a first means for holding the foot of a skier, a lever having high lateral stiffness extending up from said first means to the front of the lower leg of said skier, a second means connected to an upper portion of said lever to engage a front portion of said leg to restrict forward and lateral motion of said lever with respect to said front portion of said leg, a third means engaging said leg to restrict rearward motion of said leg with respect to said lever, and a fourth means whereby a ski may be firmly secured to said boot, wherein the construction of said lever and the construction of structural elements connecting said lever and said fourth means provides very large resistance to lateral angular motion of said lever with respect to said ski when said ski is secured to said boot, characterized by an absence of substantial restriction of rotation of said lower leg about an axis through the front of said lower leg.

2. The ski boot of claim 1 which said second means is a yoke and yoke pad movably connected to said lever to allow rotation of said yoke about an axis approximately along the front of said lower leg of said skier.

3. The ski boot of claim 1 in which said second means is a shallow yoke and yoke pad which allows rotation of said lower leg about an axis through the front of said lower leg.

4. The ski boot of claim 3 in which said shallow yoke is a portion of said lever.

5. The ski boot of claim 1 in which said second means is movable such that it may be positioned to bear at various different heights against the front of said lower leg.

6. The ski boot of claim 1 in which said second means extends to the upper portion of said lower leg.

7. The ski boot of claim 1 in which said second means extends only to the lower portion of said lower leg.

8. The ski boot of claim 2 in which said third means is a strap.

9. The ski boot of claim 3 in which said third means is a flexible strap.

10. The ski boot of claim 1 in which said fourth means comprise projections and recesses to mate safety bindings for attachment of said boot to said ski.

11. The ski boot of claim 10 in which said projections and recesses are interchangeable attachments comprising the heel shelf and toe shelf having varying surface inclinations to accomplish variable degrees of lateral canting of said boot with respect to said ski to effect lateral canting of said boot.

12. The ski boot of claim 1 in which said lever is constructed in at least two parts with these parts mutually adjustable to effect lateral canting of said boot.

13. The ski boot of claim 1 including in combination attachment means for modifying the longitudinal flexibility of said lever.

14. A ski boot for association with a ski, providing amplification of edging action, comprising a shoe with internal padding and closure means to hold the foot of a skier, a lever connected firmly to said shoe extending upwardly behind said shoe, bifurcating and its two parts extending around the lower leg of said skier to a location in juxtaposition with a front portion of said leg, said lever possessing high lateral and torsional stiffness, a yoke and yoke pad connected to said lever to engage said front portion of said leg and to transmit lateral and forward motions of said front portion of said leg to said lever, a strap connected to said lever to restrict rearward motion of said leg relative to said lever, said shoe and lever providing external means to engage ski bindings, wherein the construction of structural elements connecting said lever and said external means to engage ski bindings provides very large resistance to lateral angular motion of said lever with respect to said ski when said ski is secured to said ski boot, whereby said components allow rotation of said leg about an axis through the front of said leg.

15. The ski boot of claim 14 in which the connection between said yoke and said lever is movable to allow rotation of said yoke about an axis approximately along the front of said leg.

16. The ski boot of claim 14 in which said yoke is a shallow yoke which allows rotation of said leg about said axis through the front of said leg and in which said strap is a flexible strap.

17. The ski boot of claim 14 in which a heel shelf for engagement of a ski binding is an integral part of said lever.

18. The ski boot of claim 14 in which said lever is constructed in at least two parts with mutual adjustment thereof to effect lateral canting.

19. The ski boot of claim 14 with interchangeable attachments comprising a heel shelf and a toe shelf to effect lateral canting of said boot.

20. The ski boot of claim 14 with a snowshield extending in front of the lower leg.

21. The ski boot of claim 20 wherein the snowshield is of such construction as to allow a portion thereof to be moved away from portions of said boot to allow easy access to said portions of said boot.

22. The ski boot of claim 14 in which a portion of said lever is a leaf spring constructed of a fiber reinforced composite material, with outer layers of said fibers oriented approximately at plus and minus 45° to the length of said leaf spring.

23. The ski boot of claim 14 with mechanical means to temporarily hold the overlapping flaps of said shoe in the open position for enhanced ease of foot entry and exit.

24. The ski boot of claim 14 with attachments to modify the longitudinal flexibility of said lever.

25. The ski boot of claim 2 in which said second means is pivotally connected to said lever at said upper portion thereof.

26. A ski boot construction in accordance with claim 1 wherein said third means is connected to said second means.

27. A ski boot construction in accordance with claim 1 wherein said third means is connected to an upper portion of said lever.

* * * * *